US007237270B2

(12) United States Patent
Crye et al.

(10) Patent No.: US 7,237,270 B2
(45) Date of Patent: Jul. 3, 2007

(54) REMOVABLE GARMENT PROTECTIVE ASSEMBLY

(75) Inventors: Caleb Clark Crye, Brooklyn, NY (US); Eric Owen Fehlberg, Queens, NY (US); Gregg M. Thompson, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 179 days.

(21) Appl. No.: 10/887,342

(22) Filed: Jul. 8, 2004

(65) Prior Publication Data

US 2006/0005292 A1 Jan. 12, 2006

(51) Int. Cl.
*A41D 13/06* (2006.01)

(52) U.S. Cl. ..... 2/24

(58) Field of Classification Search ..... 2/22, 2/24, 16, 455, 242, 911; 128/878, 882; 602/23, 602/26, 62

See application file for complete search history.

(56) References Cited

U.S. PATENT DOCUMENTS 759,765 A * 5/1904 Stall ..... 2/23
4,287,885 A * 9/1981 Applegate ..... 602/26
4,831,666 A * 5/1989 Denman ..... 2/23
5,105,473 A * 4/1992 Valtakari ..... 2/461
5,377,693 A * 1/1995 Loper et al. ..... 128/845
5,566,389 A * 10/1996 Li ..... 2/16
6,279,160 B1 * 8/2001 Chen ..... 2/24

OTHER PUBLICATIONS

"Integrated/Removable Joint Protection" cover sheet and page 13 of provisional application 60/324,889 filed Sep. 26, 2001, and cited in U.S. Appl. No. US-2003-0074719-A1, published Apr. 24, 2003. Crye et al.

"Individual Protection Directorate, The Warfighters. . . our Ultimate Customer" Individual Protection Directorate, Natick Soldier Center, Natick Massachusetts, printed prior to Jul. 8, 2003.

Jul. 1, 2002, Army Times, vol. 62, No. 49, "So Cool", Matthew Cox (3 selected pages).

* cited by examiner

*Primary Examiner*—Tejash Patel
(74) *Attorney, Agent, or Firm*—Stiennon & Stiennon

(57) ABSTRACT

A garment has a pants leg with a front layer stitched along an outer peripheral seam to the pants leg to form a pocket with an interior cavity. The front layer has a central opening spaced from the outer peripheral seam and defined by an inner periphery. A protective insert, which may be formed of foam, and which is larger than the central opening is removably positionable within the pocket. A stiff cap formed of a material such as SANTOPRENE® thermoplastic elastomer, is stitched to the insert. The cap has a flange which projects outwardly from a central region around a line of attachment. The central region is no larger than the pocket central opening. The insert is removably receivable within the pocket such that the inner periphery of the front layer is engaged between the stiff cap flange and the insert.

29 Claims, 3 Drawing Sheets

REMOVABLE GARMENT PROTECTIVE ASSEMBLY

STATEMENT AS TO RIGHTS TO INVENTIONS MADE UNDER FEDERALLY SPONSORED RESEARCH AND DEVELOPMENT

The U.S. Government has a paid-up license in this invention and the right in limited circumstances to require the patent owner to license others on reasonable terms as provided for by the terms of contract No. DAAD 16-01-C-0061 awarded by the US Army Robert Morris Acquisition Natick Contracting Division of the United States Department of Defense.

CROSS REFERENCES TO RELATED APPLICATIONS

Not applicable.

BACKGROUND OF THE INVENTION

The present invention relates to protective clothing in general, and more particularly to garments which incorporate pads for protection of the wearer's joints such as elbows and knees.

There are many activities which require practitioners to take on cramped or reduced postures, such as crouching, crawling or lying prone, either momentarily or for extended periods. Moreover, it is sometimes necessary to assume these positions rapidly or unexpectedly. Kneeling and crawling, or collapsing to the knees, can be particularly injurious to the knees, either as a result of abrasion in the form of scraping, cutting, or puncturing, or as a result of impact or trauma. Flooring installers, carpenters, plumbers, and electricians are examples of tradesman who must occasionally or regularly spend time on their knees. Police officers, customs officials, and soldiers also are frequently required to kneel, crouch, or crawl, and often instantaneously in response to a sudden threat. Certain sporting and leisure activities can also lead to joint injuries if precautions are not taken.

Conventional knee and elbow pads provide some measure of protection against impact by supplying a cushion over the joint. In addition, the force of a point impact can be distributed over a greater surface area by stiff shells which are fastened to the cushion. The stiff shells also provide protection against minor cuts and abrasions, while at the same time protecting the cushion itself from degradation.

Elbow and knee pads are commonly of one of two types. Independent pads are mounted directly to the wearer's limbs by straps or belts. These devices offer the advantage of being securely attached in the vicinity of the joint to be protected, and being readily replaced for cleaning or repair. This type of pad is often employed where the wearer is otherwise lightly clad, such as in certain sporting activities. However, the tight elastic straps can be uncomfortable or can limit mobility. Moreover, the close-fitting pads can be especially hot during extended wear. In addition, the independent pads can be difficult to combine with other necessary garments, such as coveralls, fatigues, or jumpsuits, as the padding may, when used in combination with such clothing, restrict movement and ventilation and interfere with the garment. Furthermore, the hard shell of an independent pad, if worn interior to the garment, can result in the shredding or abrasion of the garment itself, which is caught between the hard shell of the pad and the hard exterior objects. If worn exterior to the garment, the pad can be excessively restrictive of the movement of the garment, and impair the mobility of the wearer.

Garment-mounted pads are often more comfortable, and the hard shell of the pad worn on the exterior of the garment fabric serves to extend the life of the garment itself. Garment and pad wear may, however, progress at different rates, and it may be desirable to replace one and not the other. Or, it may be necessary to remove any foam padding in order to adequately wash the garment, or to safely subject the garment to drying heat. Some garments have pockets into which the foam pad is inserted, but if the hard shell is also inserted into this type of pocket, it would no longer provide protection for the garment fabric.

What is needed is a replaceable garment mounted pad assembly, which includes both cushioning foam and an outwardly facing stiff shell, and which can be readily removed and reinstalled or replaced.

SUMMARY OF THE INVENTION

The protective pad assembly of this invention has a stiff plastic cap which is attached to a resilient cushioning insert or pad in such a way that a stiff flange projects outwardly from the cap to define a gap between the flange and the cushioning pad which can receive the fabric of an outer layer of a centrally opening pocket formed on the garment. The outer layer is a sheet of material with a central opening, which is stitched to the fabric of a garment pants leg or arm on all four sides. The pocket cavity so defined may open only frontwardly through the central opening. The pad is flexible and larger than the central opening in the outer layer covering the knee or elbow. The pad can be inserted by flexing and compressing it into the circumferential hole so that the circumferential lip defining the hole in the outer layer is sandwiched between the shell and the pad. The cap and the pad are thus held in position, but both parts are readily removed for cleaning, repair, or replacement. An adjustable resilient strap may be attached to the interior of the garment to permit adjustment of the fit of the pad assembly. Alternatively, the central opening may be formed in a front layer without any backing garment substrate, so that the pad may be engaged directly by the wearer.

It is an object of the present invention to provide a protective pad assembly for a garment which protects the garment and the wearer from abrasion and impact.

It is another object of the present invention to provide a protective pad assembly which is readily removed and replaced, and which is connected to a garment, without being directly connected to the wearer.

Further objects, features and advantages of the invention will be apparent from the following detailed description when taken in conjunction with the accompanying drawings.

DESCRIPTION OF THE PREFERRED EMBODIMENTS

Figure 1:
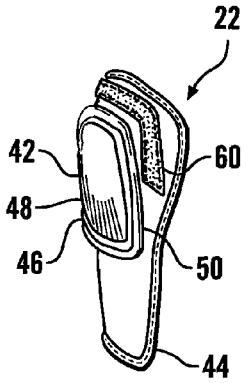
FIG. 1 is a perspective view of a protective pad insert of the protective assembly of this invention.
Figure 2:
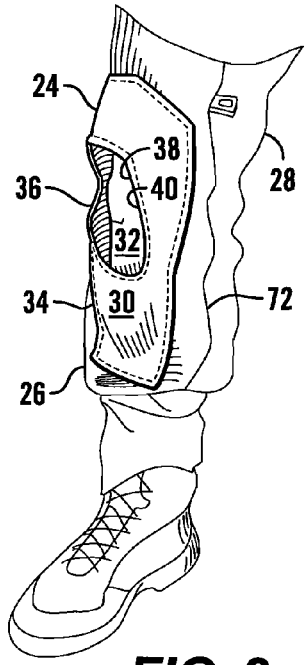
FIG. 2 is a perspective view of a garment having a pocket adapted to receive the protective pad insert of FIG. 1.

Referring more particularly to FIGS. 1–10, wherein like numbers refer to similar parts, a protective pad assembly 20 is shown in FIGS. 1–4. The protective pad assembly 20 is comprised of a protective element 22 shown in FIG. 1, and a pocket 24 formed on a pants leg 26 of a garment 28, for example a soldier's fatigues. The pocket 24 is accessible through a central opening 36, and in a first embodiment is not open at the top or sides as in a common pocket. As shown in FIG. 2, the pocket 24 is defined between a fabric front layer 30 and a frontwardly facing fabric substrate 32 of the garment 28. The protective pad assembly illustrated is a knee pad assembly, but a similar arrangement for an elbow or other body area pad may be provided.

The front layer 30 is connected to the garment substrate 32 at an outer peripheral seam 34, formed, for example, by stitching. A central opening 36 is defined in the front layer 30 which has an inner periphery 38 which may be finished by a sewn seam. It will be noted that the front layer 30 does not lie flat against the garment substrate 32, but is spaced from the substrate to define a pocket interior cavity 40 which is dimensioned to snugly receive portions of the protective element 22. The pocket 24 permits the insertion of portions of the protective element 22 through the frontwardly facing central opening 36.

Figure 4:
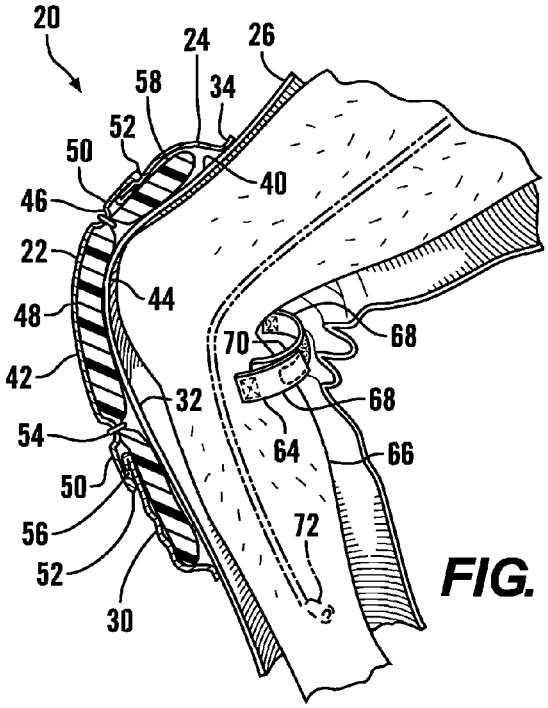
FIG. 4 is a cross-sectional view of the assembly of FIG. 3 taken along section line 4—4.

The protective element 22, as shown in FIGS. 1 and 4, has a stiff cap 42 which is connected to a protective cushioning insert 44. The insert, as shown in FIG. 1, is a tapered rectangle of cushioning material. The insert 44 is generally resilient and may be dual density polyethylene/EVA foam and may be about ¼ to ¾ inches thick. The stiff cap 42 may be fabricated of a thermoplastic elastomer such as SANTOPRENE® plastic material manufactured by Advanced Elastomer Systems of Exxon Mobil Corporation. This plastic material, although stiffer than most rubbers, nonetheless is generally softer than a plastic such as polyethylene. The stiff cap 42 may be a molded material, which preferably has a slightly convex shape to give strength and stiffness and selected to protect the joint for which it is intended. It will be noted that the stiff cap 42 has some resilience, permitting a small amount of bending of portions of the cap. As best shown in FIG. 4, the cap 42 has formed therein a shallow groove 46 which encircles the cap center 48. A flange 50, about one-half inch wide, extends outwardly from the groove 46 and from the cap center 48. The back side of the flange 50 is preferably formed with a narrow peripheral ridge 52 which is approximately a semicylindrical bead which faces toward the pocket front layer 30. The groove 46 permits a thread 54 to be stitched through the cap and the cushioning insert 44, thereby connecting the cap 42 to the protective cushioning insert 44 without the thread protruding outwardly from the cap. Other effective connection mechanisms between the cap and the insert 44 may be employed, so long as the flange 50 remains protruding from the cap 42. The flange 50 is thus not fixed to the insert 44 outwardly of the groove 46, with the result that a gap 56 is defined between the cap and the insert 44. The size of the cap center 48 is selected to be slightly smaller than the size of the inner periphery 38 of the pocket central opening 36.

Figure 3:
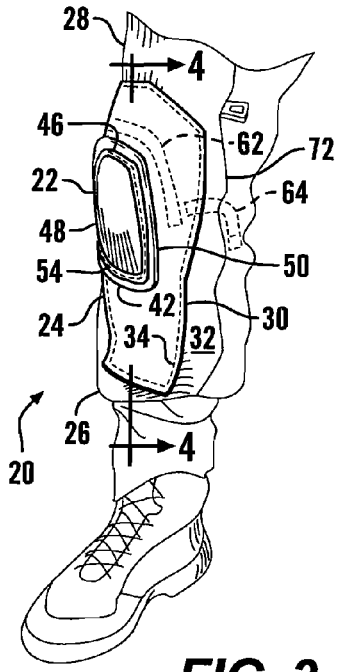
FIG. 3 is a perspective view of the garment of FIG. 2 with the protective pad insert of FIG. 1 removably received therein.

As shown in FIG. 3, the insert 44 may be inserted into the interior cavity 40 of the pocket 24 such that the inner periphery 38 of the pocket front layer 30 is received within the gap 56 between the cap 42 flange 50 and the insert 44. The cap 42 engages the material of the front layer 30, and thereby holds the protective element 22 in place. The insert 44 may be substantially larger than the cap 42. For example, a cap 42 which is about four inches wide and five inches high, may be connected to an insert which is about five inches wide and ten inches high. The cap 42 may be positioned closer to the top of the insert 44 than to the bottom. To attach the protective element 22 to the garment 28, the protective element is held so that the downwardly tapered insert 44 is compressed to pass through the central opening 36. The insert 44 is advanced until the fabric of the pocket front layer 30 is received in the gap 56 beneath the beadlike ridge 52 on the rear of the cap flange 50. The insert 44, which is readily compressed and distorted, is then worked around the perimeter of the cap 42 so the edge of the pocket front layer goes under the cap flange.

Any tendency for the upper portion of the insert 44 to move downward in the pocket as the wearer's joint is flexed may be resisted by a two-part fastener extending between the insert 44 and the pocket front layer 30. The two-part fastener may be a hook-and-loop fastener 58 such as VELCRO® fastener from Velcro Industries B.V., or another conventional fastener such as a snap fastener having a socket as one part, and a stud as the other part. The fastener 58 has an insert portion 60 facing frontwardly and affixed to the insert 44 above the cap, and a pocket portion 62 affixed to the pocket front layer 30 inside the pocket and facing the garment substrate 32. When the insert 44 is in position within the pocket 24, the two strips of hook-and-loop fastener 58 are engaged with one another to retain the protective element 22 in place.

The protective element 22 is thus securely fastened to the garment, without the need for constricting bands attached directly to the wearer, promoting greater mobility and comfort of the wearer. Moreover, the protective element 22 is readily removed for cleaning or replacement.

As shown in FIGS. 3 and 4, the garment 28 may be provided with an adjustable band 64 which adjusts the fit of the pants leg 26 without itself fully encircling the wearer's leg 66. The band 64 is positioned on the interior of the garment, and may be formed of two straps 68, at least one of which may be of an elastic material. Both straps are fastened to the pants leg, and each has one part of a hook-and-loop fastener 70. The pants leg 26 may be formed with a side zipper 72 which runs upwardly from the lower end of the pants leg, such as on ski pants. The band 64 does not cross the zipper, but may be adjusted to tighten the rear of the pants leg before the zipper 72 is closed. The band 64 is positioned behind and just below the knee of the wearer.

Figure 5:
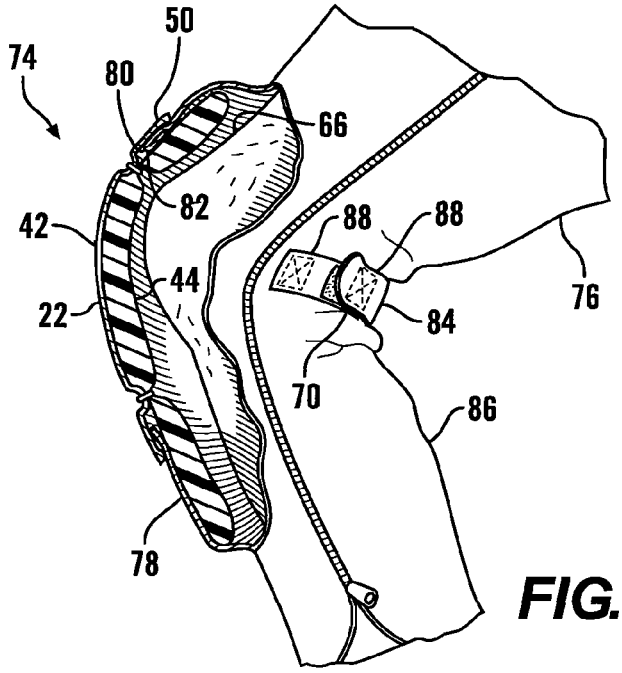
FIG. 5 is a side elevational view, partially broken away in section of an alternative embodiment protective assembly of this invention, in which the pad may engage directly against a wearer's knee.

An alternative embodiment protective pad assembly 74 is shown in FIG. 5. The protective pad assembly 74 has a protective element 22 as in the assembly 20, but is used in connection with a garment 76 in which the front layer 78 does not overlie the garment substrate. Instead the front layer 78 is continuous with or is connected to the substrate, and the front layer is open at its rear to the wearer's limb 66 having the joint to be protected. The front layer 78 has an inner periphery 80 defining a central opening 82. As in the assembly 20, the stiff cap 42 is positioned frontwardly of the front layer 78, and the protective cushioning insert 44 extends rearwardly of the front layer, with the fabric of the front layer engaged between the flange 50 of the cap 42 and the cushioning insert 44. In the assembly 74, the cushioning insert 44 may engage directly against the wearer's leg, without the substrate of the garment intervening. The assembly 74 may also be provided with an exterior rear adjustable belt 84 in addition to or in place of the interior adjustable band 64 shown in FIG. 4. The adjustable belt 84 is attached to the exterior of the garment and is used to adjust the fit of the pants leg 86 of the garment, without itself fully encircling the wearer's leg 66. The adjustable belt 84 may be formed of two straps 88, at least one of which may be of an elastic material. Both straps 88 are fastened to the pants leg 86, and each has one part of a hook-and-loop fastener 70.

Figure 6:
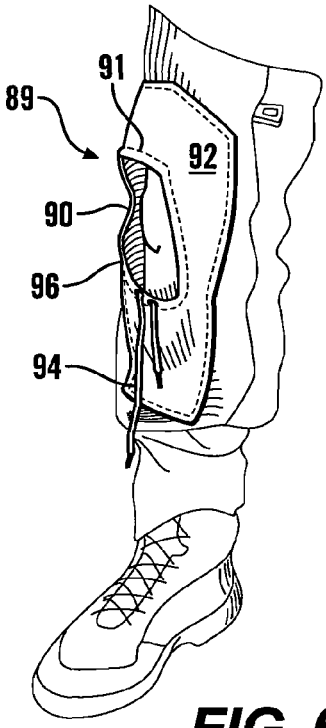
FIG. 6 is a perspective view of another alternative embodiment protective assembly of this invention, with the protective insert removed from the garment, and showing a draw string assembly prior to being constricted.

An alternative embodiment protective pad assembly is shown in FIG. 6 which is similar to the assembly 20, but which has a garment assembly 89 with a hem or casing 91 around the inner periphery 90 of the front layer 92 surrounding the central opening 96 through which a drawstring 94 extends. The drawstring is an inelastic or elastic cord, and it works with a protective element 22 as described above (not shown in FIG. 6). By adjusting the drawstring 94 and tying the ends together or by using a conventional adjustable mechanical fastener where the ends come together, the diameter of the central opening 96 is reduced after the protective element 22 is in place, thereby securing the cap 42 to the front layer by sandwiching the constricted diameter opening between the cap and the cushioning insert 44 of the protective element. Alternatively, the cord may be an elastic member that may be inaccessible to the user. Such a device would simply permit the central opening to be stretched when the protective element cap is inserted through the central opening 96. The opening would then return to a smaller size under the force of the elastic member.

Figure 7:
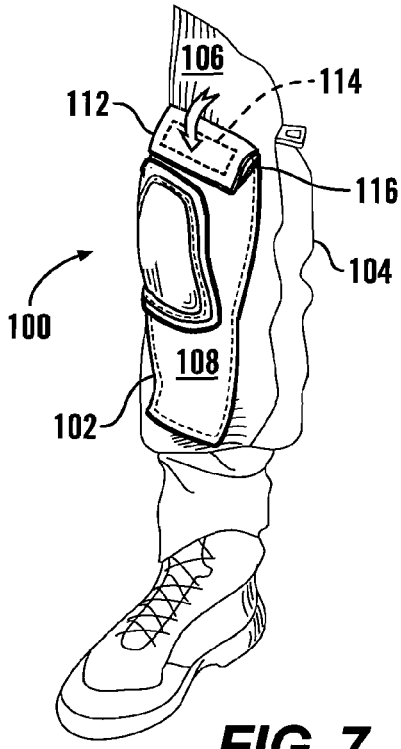
FIG. 7 is a perspective view of yet another alternative embodiment protective assembly of this invention, in which the protective insert pocket has an opening along one edge which is closed with a flap.
Figure 10:
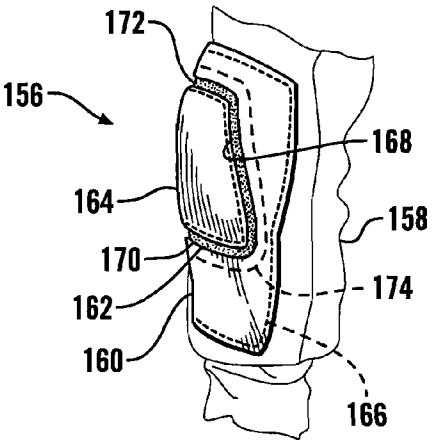
FIG. 10 is a fragmentary perspective view of yet another alternative embodiment protective assembly of this invention, in which the insert is attached to the front layer of the pocket by a hook and loop fastener.

Another alternative embodiment protective pad assembly 100 is shown in FIG. 7. The assembly 100 is similar to the assembly 20, except that the pocket 102 formed between the garment 104 substrate 106 and the front layer 108 having a central opening (not shown), has an opening at the top to permit the protective element 22 to be inserted between the front layer 108 and the substrate 106. The protective element 22 is installed by first folding up a pocket flap 112, and then inserting the element through an outer periphery opening 116. The cap 42 is then worked through the central opening, and secured in place as described with respect to the assembly 20. Once the element 22 is installed, the pocket flap 112 is closed, and secured in place with a conventional fastener, such as a two-part hook-and-loop fastener 114. It should be noted that although the pocket outer periphery opening 116 is shown in an upper edge, the opening and the covering flap 112 may alternatively be formed in a side or the bottom of the pocket.

Alternatively, the adjustable belt may be provided as a single strap which passes through a loop fastened to the interior of the garment, and then attaching back to itself. Or, alternatively, the adjustable belt may be a single strap fastened at one end to the garment and having hook and loop fastener material which fastens to hook and loop fastener material on the garment interior itself. Or both these alternatives may be provided on the exterior of the garment.

Figure 8:
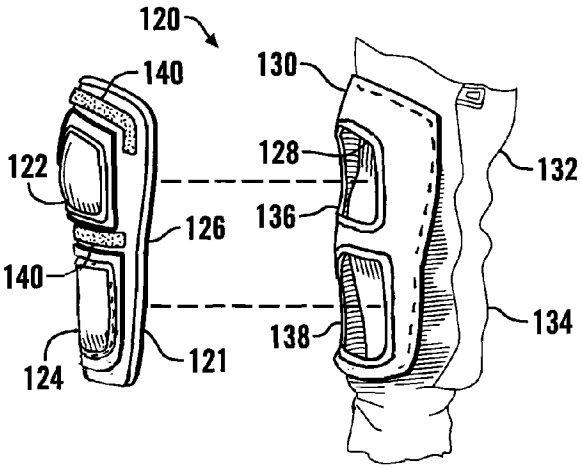
FIG. 8 is an exploded fragmentary perspective view of an alternative embodiment protective assembly of this invention having a knee and shin protective cap attached to a single cushioning insert and receivable within a front layer of material having two front openings.

It should be noted that a protective element could have a single insert which is provided with two or more stiff caps, each one being engagable with a separate opening in the front layer of material. For example, as shown in FIG. 8, a combination knee and shin guard protective assembly 120 has a protective element 121 with a stiff knee cap 122 and a stiff shin cap 124 fastened to a single cushioning insert 126. The insert 126 is received within a pocket 128 defined between a front layer 130 of fabric and the front of the garment 132 pants leg 134. The front layer 130 has a top central opening 136 with which the knee cap 122 engages, and a lower central opening 138 with which the shin cap 124 engages. The knee cap 122 and shin cap 124 each have protruding flanges which engage the fabric of the front layer around the openings 136, 138 in a fashion similar to that described above with respect to the assembly 20. The protective element 121 may be provided with hook and loop fasteners 140 to engage with the inwardly facing surface of the front layer 130.

It should be noted that the protective element may be formed as a single molded plastic part, rather than as an assembly of two parts. The protective element could be formed in the mold with two different plastic materials introduced into the mold, one material forming the more resilient insert, and one forming the stiffer cap. Alternatively, the stiff cap and the outer surface of the cushioning insert could be formed as a single part, for example of SANTOPRENE® plastic material, and the remainder of the cushioning insert could be formed as sheet of foam material glued or stitched to said single part.

Figure 9:
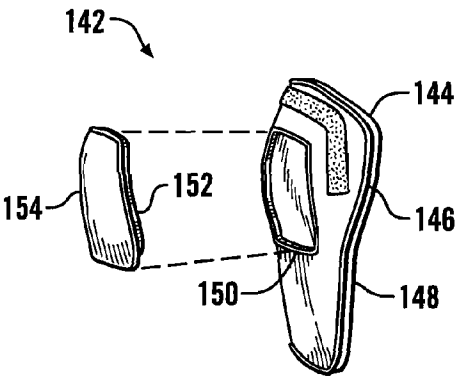
FIG. 9 is an exploded perspective view of an alternative embodiment protective assembly of this invention having a stiff cap which is separable from the insert in a snap fit relationship.

Another alternative embodiment protective element 142 is shown in FIG. 9. The protective element 142 has a cushioning insert 144 with a molded plastic front wall 146 to which a foam sheet 148 is adhered. The front wall 146 has a snap fit projection 150 which engages with a rearwardly extending snap fit protrusion 152 on the stiff cap 154. When used with the garment 104, shown in FIG. 7, the insert 144 is positioned within the pocket 102, and the cap is releasably snapped into place to secure the cap 154 to the insert 144, the front layer is thereby clamped between the cap and the cushioning insert 144. Alternatively, threaded structures may be formed on the insert and the cap to allow the two parts to be releasbly screwed together.

It should be further noted that the protective element may engage with the front layer of material on the garment without engagement between the cap and the front layer. An alternative embodiment protective assembly 156, shown in FIG. 10, has a garment 158 with a front layer 160 having a central opening 162 which is slightly larger than the cap 164, for example, large enough to define about a 1/16 inch margin around the cap when it is installed. The cap 164 is fixed to a cushioning insert 166 which is received within the pocket 168. One half 170 of a two-part fastener is affixed to the frontwardly facing surface 172 of the insert 166 in a strip which encircles the cap 164, and the other half 174 of the two-part fastener is fixed to the interior of the front layer of fabric encircling the central opening 162. The two-part fastener is preferably VELCRO® hook and loop fastener, or multiple snap fasteners, or other conventional fastener.

It should also be noted that a gap may be formed entirely on structure of the stiff cap to engage the inner periphery of the central opening in the front layer. Thus the cap can engage the front layer with a molded groove into which the front layer extends, without requiring the front layer to be engaged directly against the cushioning insert.

It is understood that the invention is not limited to the particular construction and arrangement of parts herein illustrated and described, but embraces all such modified forms thereof as come within the scope of the following claims.

We claim:

1. A garment protective assembly comprising:

a garment having a front layer positionable to overlie a portion of a human body which is to be protected;

portions of the front layer which define a central opening defined by an inner periphery;

a protective insert being larger than the central opening; and a stiff cap fixed to the protective insert, the cap having a central region surrounded by a line of attachment where the cap is fixed to the protective insert, wherein a flange projects outwardly from the central region, the flange projecting frontwardly of the insert, the flange having portions which engage the front layer, such that the cap extends frontwardly of the front layer, and the protective insert extends rearwardly of the front layer, the front layer being engaged between the cap flange and the protective insert, and the insert being thus removably connected to the garment.

2. The garment protective assembly of claim 1 wherein the garment has a flexible substrate which is positionable to overlie the joint, and wherein the front layer extends frontwardly of the garment substrate to define a pocket positioned rearwardly of the central opening to receive the insert therein.

3. The garment protective assembly of claim 2 wherein the front layer is attached to the garment substrate along an outer periphery, and where portions of the periphery open outwardly to permit the insert with attached cap to be inserted into the pocket, prior to the cap being passed through the central opening.

4. The garment protective assembly of claim 3 further comprising a pocket flap which selectably closes the portions of the periphery which open outwardly.

5. The garment protective assembly of claim 1 further comprising a hem which extends around the front layer central opening, and wherein a drawstring extends within the hem, to permit the dimensions of the central opening to be restricted by adjusting the drawstring.

6. The garment protective assembly of claim 1 further comprising;

a first part of a two-part fastener mounted to the front layer; and a second part of the two-part fastener mounted to the insert to engage with the first part rearwardly of the front layer.

7. The garment protective assembly of claim 6 wherein the first-part of the two-part fastener comprises one half of a hook-and-loop fastener, and wherein the second part of the two-part fastener comprises another half of a hook-and-loop fastener.

8. The garment protective assembly of claim 6 wherein the two-part fastener comprises the two parts of a snap fastener.

9. The garment protective assembly of claim 1 wherein portions of the cap define a groove which encircles the cap central region, and wherein a thread extends within the groove, the thread stitching the cap to the protective insert.

10. The garment protective assembly of claim 1 wherein the flange has a peripheral ridge which projects from the flange towards the front layer.

11. The garment protective assembly of claim 1 further comprising a second cap fixed to the protective insert, and wherein the front layer has a second central opening which receives the second cap.

12. The garment protective assembly of claim 1 wherein the protective insert has a front wall having a snap fit projection, and the cap has a rearwardly extending snap fit protrusion which engages the snap fit projection with portions of the front layer secured therebetween.

13. The garment protective assembly of claim 1 further comprising an adjustable band mounted to the garment, the band comprising:

a first strap fastened to the garment substrate;

a second strap fastened to the garment substrate; and a two-part hook and loop fastener, having a first part on the first strap, and a second part on the second strap, the first strap being thereby releasably engagable with the second strap to adjust the dimensions of the garment rearward of the insert.

14. The garment protective assembly of claim 13 wherein the garment has an interior, and wherein both the first strap and the second strap are positioned on the interior of the garment.

15. A garment protective assembly comprising:

a garment having a flexible substrate positionable to overlie a portion of a human body to be protected;

a front layer fixed to the garment substrate, wherein a pocket is defined between the front layer and the garment substrate, the front layer being fixed to the garment substrate by an outer peripheral seam, wherein the pocket defines an interior cavity which is exterior to the garment substrate;

portions of the front layer which define a central opening, the central opening being spaced from the outer peripheral seam and providing access to the pocket interior cavity, the central opening being defined by an inner periphery;

a protective insert which is removably positionable within the pocket, the insert being larger than the central opening; and a stiff cap fixed to the protective insert, the cap having a central region surrounded by a line of attachment, and wherein a flange projects outwardly from the central region around the line of attachment, the flange projecting frontwardly of the insert, and wherein the central region is no larger than the pocket central opening, and wherein the protective insert is removably receivable within the pocket such that the inner periphery of the front layer is engaged between the stiff cap flange and the insert.

16. The garment protective assembly of claim 15 wherein portions of the outer peripheral seam are interrupted to open outwardly to permit the insertion into the pocket of the insert with attached cap, and to permit the cap to be passed through the central opening.

17. The garment protective assembly of claim 16 further comprising a pocket flap which selectably closes the interrupted portions of the outer peripheral seam which open outwardly.

18. The garment protective assembly of claim 15 further comprising a hem which extends around the front layer central opening, and wherein a drawstring extends within the hem, to permit the dimensions of the central opening to be restricted by adjusting the drawstring.

19. The garment protective pad assembly of claim 15 further comprising;

a first part of a two-part fastener mounted to the front layer; and a second part of the two-part fastener mounted to the insert to engage with the first part within the pocket.

20. The garment protective pad assembly of claim 19 wherein the first part of the two-part fastener comprises one half of a hook-and-loop fastener, and wherein the second part of the two-part fastener comprises another half of a hook-and-loop fastener.

21. The garment protective assembly of claim 15 wherein portions of the cap define a groove which encircles the cap central region, the groove coinciding with the line of attachment, and wherein a thread extends within the groove, the thread stitching the cap to the protective insert.

22. The garment protective assembly of claim 15 wherein the flange has a peripheral ridge which projects from the flange towards the front layer.

23. The garment protective assembly of claim 15 further comprising an adjustable band mounted to the garment, the band comprising:

a first strap fastened to the garment substrate;

a second strap fastened to the garment substrate; and a two-part hook and loop fastener, having a first part on the first strap, and a second part on the second strap, the first strap being thereby releasably engagable with the second strap to adjust the dimensions of the garment rearward of the insert.

24. The garment protective assembly of claim 23 wherein the garment has an interior, and wherein both the first strap and the second strap are positioned on the interior of the garment.

25. The garment protective assembly of claim 15 further comprising a second cap fixed to the protective insert, and wherein the front layer has a second central opening which receives the second cap.

26. A garment protective assembly comprising:

a garment having a front layer positionable to overlie a portion of a human body which it is desired to protect;

portions of the front layer which define a central opening defined by an inner periphery;

a protective insert being larger than the central opening; and a stiff cap fixed to the protective insert, the cap projecting from the central opening and extending frontwardly of the front layer, and the protective insert extends rearwardly of the front layer, such that the front layer is engaged between the cap and the protective insert, wherein the insert is releaseably engaged with the front layer, the insert being thus removably connected to the garment.

27. The garment protective assembly of claim 26 further comprising:

a first part of a two-part fastener fixed to the protective insert and facing frontwardly and encircling the stiff cap; and a second part of the two-part fastener fixed to the front layer and facing rearwardly to engage the first part of the two-part fastener.

28. The garment protective assembly of claim 27 wherein the two-part fastener is a hook and loop fastener.

29. The garment protective assembly of claim 26 wherein the protective insert has a front wall having a snap fit projection, and the cap has a rearwardly extending snap fit protrusion which engages the snap fit projection with portions of the front layer secured therebetween.

* * * * *

UNITED STATES PATENT AND TRADEMARK OFFICE

CERTIFICATE OF CORRECTION

PATENT NO. : 7,237,270 B2
APPLICATION NO. : 10/887342
DATED : July 3, 2007
INVENTOR(S) : Caleb Clark Crye It is certified that error appears in the above-identified patent and that said Letters Patent is hereby corrected as shown below:

In column 7, line 17, “assembly comprising” should be --assembly for a joint, the assembly comprising--

In column 7, line 19, “of a human body which” should be --of the joint which--

In column 8, line 35, “assembly comprising” should be --assembly for a joint, the assembly comprising--

In column 8, line 37, “overlie a portion of a human body to be protected;” should be --overlie the joint;--

In column 9, line 10, “protective pad assembly” should be --protective assembly--

In column 9, line 16, “protective pad assembly” should be --protective assembly--

In column 10, line 5, “assembly comprising” should be --assembly for a joint, the assembly comprising--

In column 10, line 7, “of a human body which it is desired to protect;” should be --of the joint;--

Signed and Sealed this

Twenty-eighth Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 7,237,270 B2
APPLICATION NO. : 10/887342
DATED : July 3, 2007
INVENTOR(S) : Caleb Clark Crye et al.

It is certified that error appears in the above-identified patent and that said Letters Patent is hereby corrected as shown below:

Column 1, delete lines 4-14.

Signed and Sealed this
Sixth Day of September, 2011

David J. Kappos

David J. Kappos
*Director of the United States Patent and Trademark Office*